US009781780B1

(12) United States Patent
Van Arendonk et al.

(10) Patent No.: US 9,781,780 B1
(45) Date of Patent: Oct. 3, 2017

(54) APPARATUS, METHOD, AND SYSTEM FOR GALVANICALLY ISOLATED CONTROL AND MONITORING OF LED DRIVERS

(71) Applicant: Musco Corporation, Oskaloosa, IA (US)

(72) Inventors: Kevin D. Van Arendonk, Pella, IA (US); David L. Blanchard, Oskaloosa, IA (US); Andrew J. Schembs, Johnston, IA (US)

(73) Assignee: Musco Corporation, Oskaloosa, IA (US)

( * ) Notice: Subject to any disclaimer, the term of this patent is extended or adjusted under 35 U.S.C. 154(b) by 28 days.

(21) Appl. No.: 14/831,986

(22) Filed: Aug. 21, 2015

Related U.S. Application Data

(60) Provisional application No. 62/040,741, filed on Aug. 22, 2014.

(51) Int. Cl.
*H05B 33/08* (2006.01)

(52) U.S. Cl.
CPC ..... *H05B 33/0809* (2013.01)

(58) Field of Classification Search
None
See application file for complete search history.

(56) References Cited

U.S. PATENT DOCUMENTS 8,587,278 B2 11/2013 Mednik et al.
8,698,421 B2 4/2014 Ludorf
8,952,628 B1 * 2/2015 Gordin ..... H05B 37/0227 315/291
2011/0204820 A1 * 8/2011 Tikkanen ..... H05B 33/0815 315/294
2012/0002377 A1 1/2012 French et al.

OTHER PUBLICATIONS

Data Sheet, "MAX253 Transformer Driver for Isolated RS-485 Interface", Maxim Integrated, Apr. 2010 (1 pg.).
Data Sheet, "Si8640/41/42/45 Low-Power Quad-Channel Digital Isolator", Silicon Labs, Copyright 2013 (1 pg.).
Data Sheet, "PIC24HJXXXGPX06/X08/X10, High-Performance, 16-Bit Microcontrollers", Microchip, Copyright 2009 (2 pgs.).
Data Sheet, "Products/0/154242, 25W-100W Internal Waterproof LED Driver", LED Power Supply Manufacturer, Evada Electronics, Aug. 22, 2014 (1 pg.).
Data Sheet, "AC Input, and Isolated High-Power LED Driver for Illumination, BP5875", Rohm Semiconductor, www.rohm.com/contact/, (undated, but retrieved earlier than Aug. 22, 2014)(2 pgs.).
Web Article, "Taber Transducer: Isolated vs. Non-Isolated Circuits", Web Article, www.tabertransducer.com/isolated-non-isolated. (undated, but retrieved earlier than Aug. 22, 2014)(2 pgs.).

* cited by examiner

*Primary Examiner* — Dedei K Hammond
(74) *Attorney, Agent, or Firm* — McKee, Voorhees & Sease, PLC

(57) ABSTRACT

A system, apparatus, and method for operating one or more drivers of light sources, such as can be used with LED lighting fixtures, wherein main power to the drivers is galvanically isolated from communication functionalities to and from the drivers. In one example, a controller can receive information or send information to the drivers in a galvanically isolated manner. The galvanic isolation can be accomplished in different ways and configurations for high flexibility of design.

24 Claims, 10 Drawing Sheets

APPARATUS, METHOD, AND SYSTEM FOR GALVANICALLY ISOLATED CONTROL AND MONITORING OF LED DRIVERS

CROSS-REFERENCE TO RELATED APPLICATIONS

This application claims priority to Provisional Application U.S. Ser. No. 62/040,741 filed on Aug. 22, 2014, all of which is herein incorporated by reference in its entirety.

I. BACKGROUND OF THE INVENTION

The present invention generally relates to lighting. More specifically, the present invention relates to LED lighting control and monitoring.

Electrical systems that have different power sources can exist at different potentials with reference to each other. Often, the point of lowest potential in the system functions as a ground, such that any point electrically connected to that point will have zero potential with reference to that point. Ohm's law (V=I×R or I=V/R) states that for a given resistance, current flow through a conductor between two points is directly proportional to the potential difference across the two points. With this in mind, a point designated as ground and having zero potential within a given system can still have a non-zero potential with reference to a similar system that has a different power source. Therefore control or monitoring systems that connect the reference (usually negative) leads of different power systems (for example the drivers which supply current to LED fixtures by referencing them to a common reference point or ground on the control board) will likely allow ground-path currents or EMI into the system, which can interfere with system operation, or cause signal degradation or even possible component damage.

One example of this type of situation is a type of LED lighting system used for sports and wide-area lighting. These systems are powered by AC three-phase mains power, and use drivers which provide current-controlled DC power to LED fixtures. For some of these drivers, the DC negative lead (usually the reference lead or ground lead) may not be isolated from the AC power source, which itself can be at a different reference potential relative to other AC power sources; the result is that the ground or reference potential for any given driver DC power output can have a different potential from another driver or reference.

LED lighting systems, particularly as used for sports fields or wide-area lighting, can require multiple drivers at a given pole or mounting location in order to provide power for several LED fixtures. Depending on many factors, the number of drivers needed at a single location can range from only one, where only one or two fixtures are needed, to four, eight, or even more, if many fixtures are needed to provide a high level of illumination. One method of controlling multiple fixtures is simply to have a single control module or analogous device for each driver. This is often not desirable since many controllers would be required whenever multiple drivers are used. Another method, which will be discussed further below, is to construct a control module or device that has a fixed number of channels, for example four. By channels it is meant an independent hardware component that coordinates all I/O to the controller. This hardware can be physically located on the same circuit board in close proximity to other channels and to the controller, but which essentially sends information which relates to a remote device and which has used components unique to the channel to process, modify, or interpret already processed data to the controller. So for a controller with four channels, each channel processes information about the device it controls or monitors, and sends the processed results, not the raw information, back to the main controller. This kind of controller works well for use with, e.g., four drivers and has many benefits. However for the locations needing a number of drivers not divisible by four, it means one or more of the channels will not be used which can be a waste of resources. Further, since the control program or schedule for the fixtures at a single pole or location is often the same, whether there are a few or many fixtures, requiring one controller for every four fixtures is not always ideal. For example, it requires that multiple channels are needed in the lighting control systems just to turn on or off or to dim the fixtures at that one location. For a field or sports complex with many different poles, this can increase the cost and complexity of lighting control systems.

Further, LED lighting covers a wide range of lighting needs, for example lighting sports fields at levels sufficient for television broadcast, lighting pedestrian areas at a much lower level, lighting emergency exits, etc. The controls and drivers needed for different lighting applications can be quite different, since sports field lighting may use high power drivers each providing 1000-1500 watts to an LED fixture, while pedestrian lighting may use 100 watt drivers, and emergency exit lighting might use LED fixtures of 5 watts or less that have integrated drivers; further all of these drivers may have different communications protocols and may be variously isolated, partially isolated, or non-isolated. Still further, it may be desired to add additional LED lighting systems having different control systems to an existing installation, where it would be preferred to use an existing controller rather than adding a new controller. And one driver out of three or four in an existing system could fail and need to be replaced; if the remaining drivers are still workable, it might be desirable to replace the one driver with one of a different control type or isolation topology, while not replacing the remaining drivers. For example, the identical driver might no longer be available, or a newer driver could be available which is more efficient than the older drivers but which does not warrant changing all the drivers. And further still, since new systems and devices which provide benefits to the kinds of venues that use LED lighting are constantly becoming available, the ability to control electronic devices not limited to LED lighting could be highly desirable.

In all of these circumstances, the ability to control drivers having different control or isolation configurations, or to control other electronic devices would be beneficial.

Therefore it is desirable to find a way to isolate the control and measurement functions from the different ground potentials, to allow lighting controllers to address as few or as many drivers as are needed at a single pole or location, and further to provide varied, flexible means, apparatus, system, technique, or method for interfacing with LED drivers and other electronic devices. In the current state of the art, as far as can be determined, there is no method, system, or apparatus that provides these functions. This is a serious deficiency for which a solution will be highly beneficial.

From the foregoing it can be seen that there are competing interests and factors in supplying both control/power functionality and communication functionality within these types of systems. For example, certain power levels in the use of certain types of components and combination of components for certain situations. Yet practicality, economics, and sometimes even conventional-wisdom may work against those components or combination of components. Furthermore, when trying to incorporate a variety of different functional sections and electrical systems, a balancing of factors many times must take place. Some of the factors can be antagonistic to one another. As mentioned above, isolation of functionality may sometimes be indicated but practicality works against that. Sometimes conventional-wisdom would default towards ignoring some potential issues such as being at risk of unwanted current flow between functional sections. Still further, flexibility can be important. But this can be antagonistic to universality. For example, it can be desirable to substitute different types of components into a system. But inherently it is difficult to design the system to accommodate this.

Space and economy also come into play. But sometimes they are antagonistic to the functions of the electrical circuit.

Thus, there is room for improvement in the art.

II. SUMMARY OF THE INVENTION

What is envisioned is a method, system, and apparatus for LED lighting including but not limited to sports or area illumination (e.g. LED lighting applications using high power drivers and typically driving LEDs at high current levels) comprising plural LED drivers and associated LED fixtures, a main controller, and plural galvanically isolated interface channels, wherein isolation is maintained between individual drivers and between the individual drivers and the controller.

Further envisioned is a method, system, and apparatus as described wherein the isolated interface channels monitor LED or other driver parameters such as driver voltage and current, and further communicate information about said parameters across said isolation to main controllers.

Further envisioned is a method, system, and apparatus as described wherein the controller provides control signals to plural LED or other drivers either separately from or by way of the isolated interface channels.

Further envisioned is the method, system, and apparatus as described wherein the galvanic isolation is sufficient for at least high voltage differentials, which can be on the order of one or more thousands of volts.

Further envisioned is a method, system, and apparatus wherein control for electronic devices comprises a master control and multiple interchangeable slave controllers configured for compatibility with various electronic devices. Further envisioned is said method, system, and apparatus wherein at least one of the electronic devices controlled is an LED driver; or wherein multiple LED drivers are controlled, using either identical or different slave controllers. Still further envisioned is said control system wherein slave controllers are configured for different combinations of driver power and control channel isolation, wherein controller slave modules are configured to control fully isolated drivers, partially isolated drivers, and non-isolated drivers. Still further envisioned is a controller system comprising a master and multiple slave controllers wherein different communications protocols are used to control electronic devices including LED drivers, wherein the communications protocols may include signals such as analog 0-10 VDC dimmer signals, RS-485 networking, or other analog or digital protocols which may be propagated by wire, wireless, RF, IR, fiberoptic, or other means, apparatus, systems, techniques, or methods.

These and other objects, features, advantages, or aspects of the present invention will become more apparent with reference to the accompanying specification and claims.

III. BRIEF DESCRIPTION OF THE DRAWINGS

From time to time in this description reference will be taken to the drawings which are identified by figure number and are summarized below.

IV. DETAILED DESCRIPTION OF EXEMPLARY EMBODIMENTS

A. Background

Figure 1:
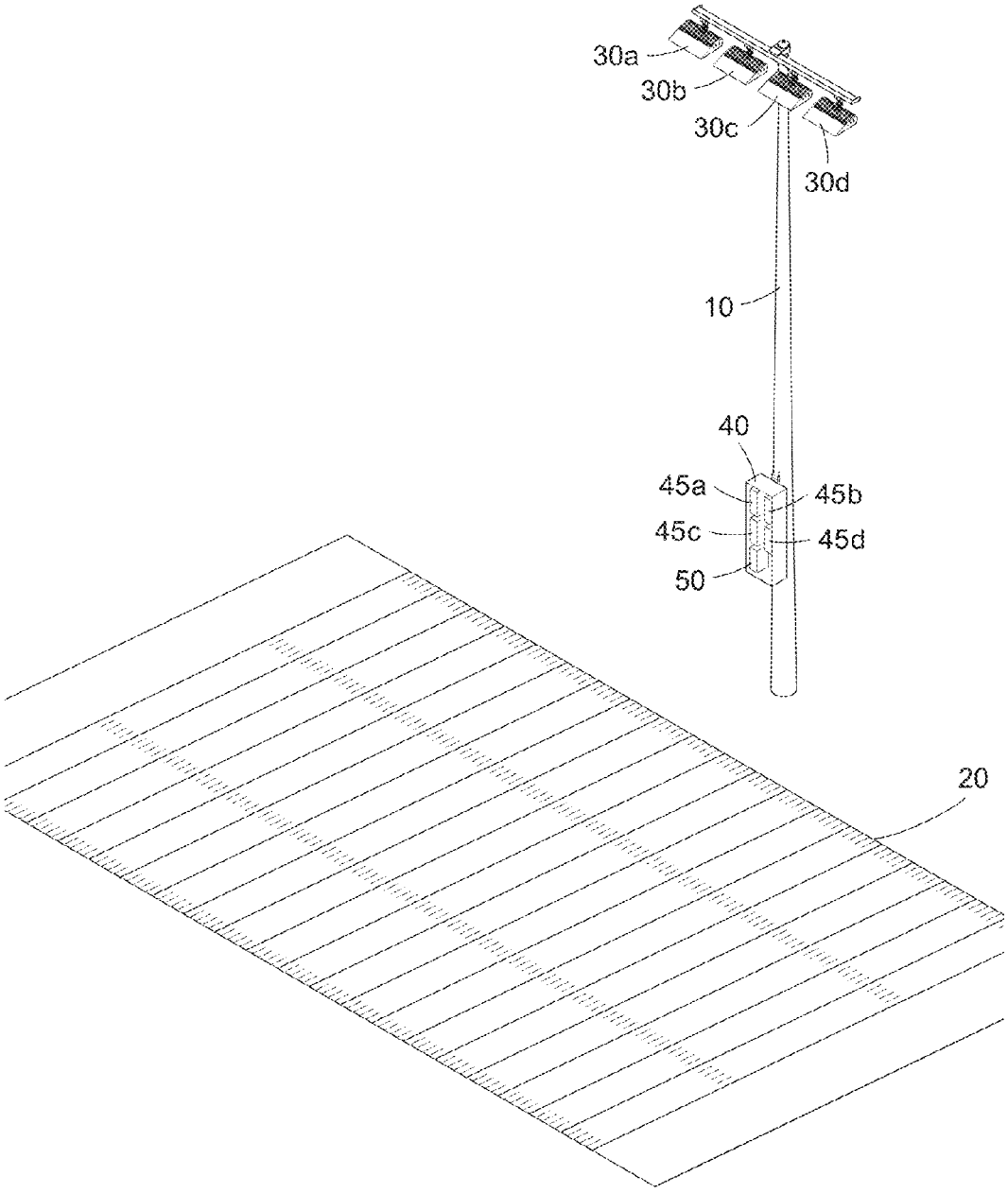
FIG. 1 illustrates an exemplary LED lighting system.

To further understanding of the present invention, specific exemplary embodiments according to the present invention will be described in detail. Frequent mention will be made in this description to the drawings. Reference numbers will be used to indicate certain parts in the drawings. The same reference numbers will be used to indicate the same parts throughout the drawings unless otherwise indicated.

Figure 2A:
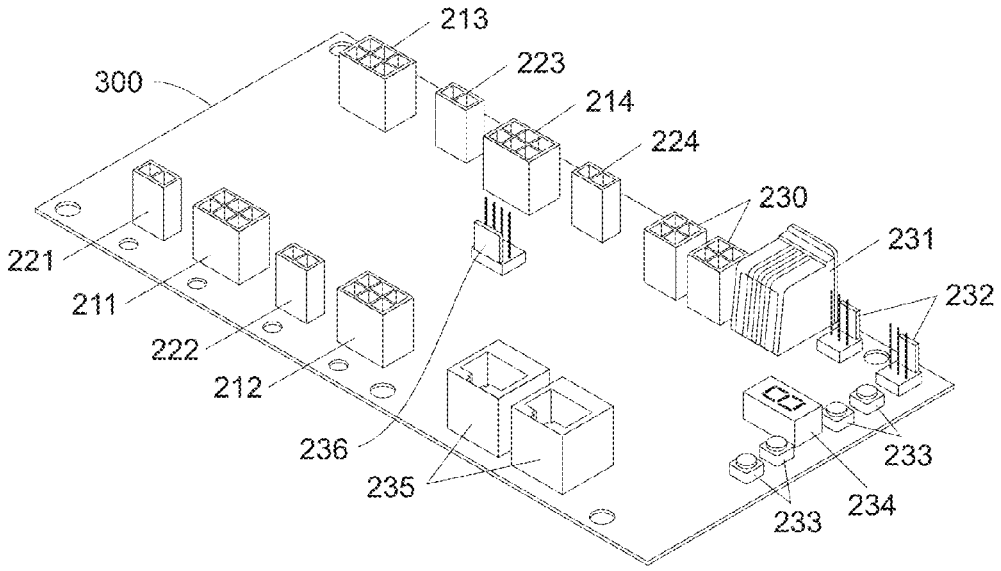
FIGS. 2A-2B illustrate respectively a top and bottom diagrammatic view of a control board according to existing art.
Figure 2B:
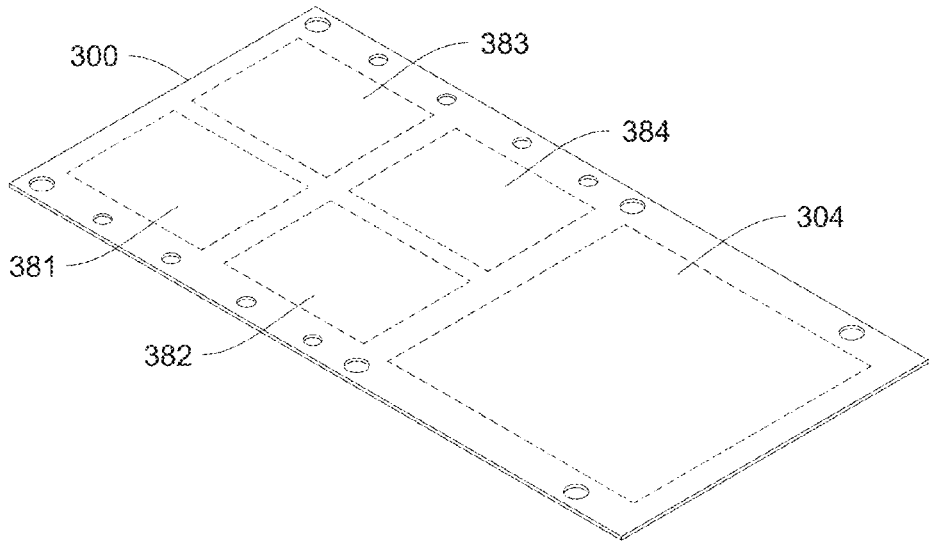
Figure 3:
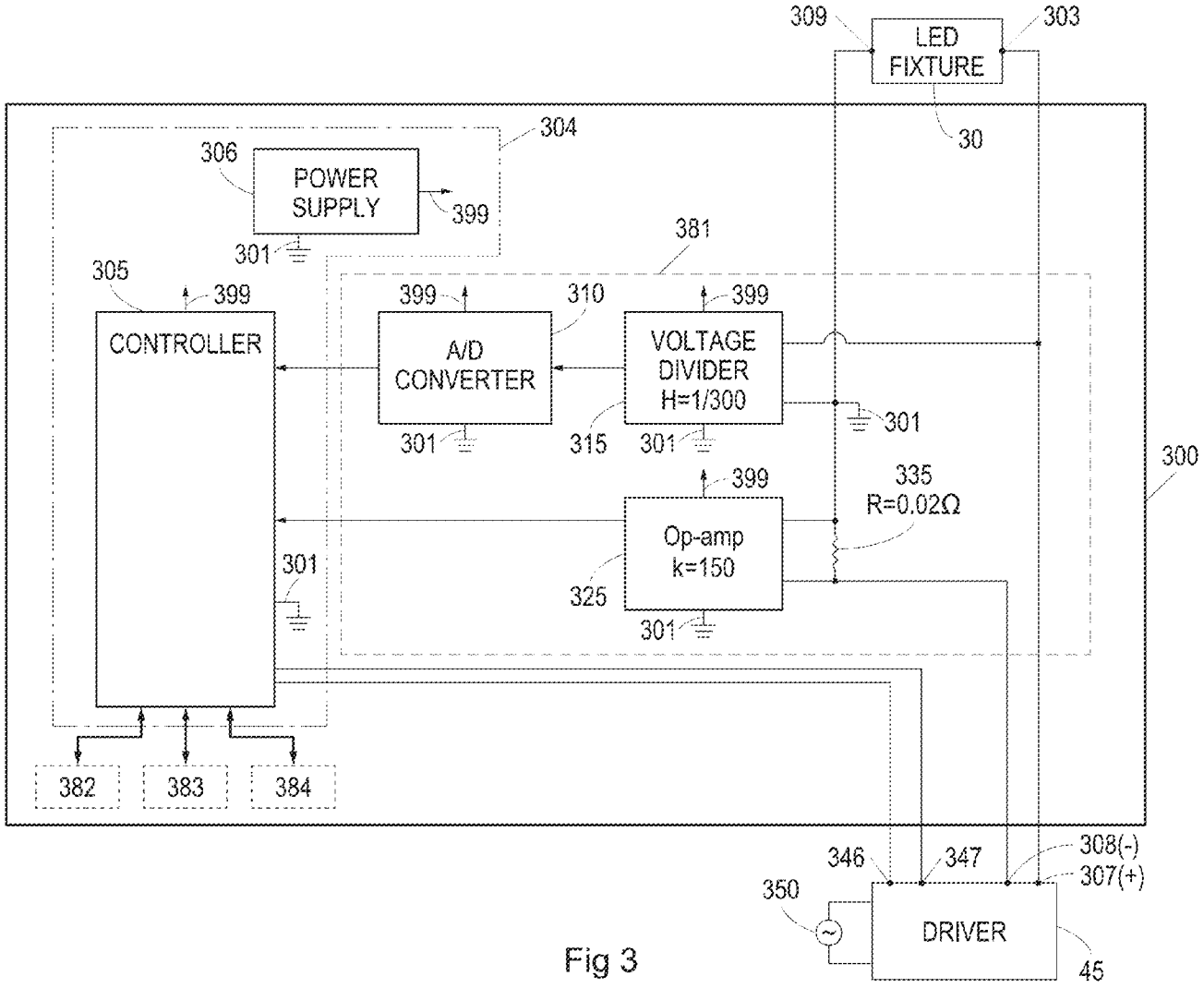
FIG. 3 illustrates a functional diagram of an existing control board and related components.

An exemplary non-isolated system according to existing art for controlling and monitoring LED drivers which are not galvanically isolated from their associated AC power sources is illustrated in FIG. 1, FIGS. 2A-B, and FIG. 3. Four LED fixtures 30*a*-30*d*, FIG. 1, are mounted on pole 10 at football field 20. Drivers 45*a*-45*d* provide power individually to LED fixtures 30*a*-*d* respectively. Controller enclosure 50 contains control board 300, which is shown in FIGS. 2A-B and FIG. 3. Controller enclosure and drivers are installed in pole enclosure 40. AC power is provided through the hollow pole to the drivers, and a wiring system connects the drivers and controller with the LED fixtures.

In this exemplary state of the art system, as will be discussed in greater detail below, a controller monitors driver voltage and current, and separately outputs a 0-10 VDC dimming signal to a driver in order to control LED fixture operation. Driver voltage is measured between the positive and negative fixture leads. Driver current is calculated by measuring voltage drop of the driver current across a very small resistance placed in the fixture current path. This type of system works well with drivers which are isolated from the AC power source, since with these types of drivers, connecting the driver leads across the controller ground does not create potential difference between grounds nor the possibility of currents flowing between the different drivers. However, some drivers use a non-isolated topology wherein the negative lead of the driver output is not galvanically isolated from the AC current source. And there is benefit to using this type of driver since it avoids the small efficiency loss created by transmitting power across an isolation transformer within the driver. But a multi-channel controller as previously described cannot avoid ground problems if drivers are not isolated or if the isolation issues are not addressed. So if voltage and current were measured and reported as per above but with non-isolated drivers, damaging currents and EMI could travel across the ground connection. Therefore, if the issues of non-isolated grounds can be resolved it can be advantageous to use non-isolated drivers.

The exemplary state of the art control system discussed above is represented by the components shown in FIG. 3 and described as follows: driver 45 (only one is shown) is powered by AC mains power source 350. Control board 300 contains controller module 304 with main controller 305, and I/O modules 381, 382, 383, and 384. Note that only module 381 is shown in detail but the remaining three I/O modules function identically. Control board 300 components are powered by DC power 399 from power supply 306, and grounded via ground 301.

DC power 399 is indicated between components as follows. DC power 399 out of supply 306 is indicated by a short arrow. The other components that receive and use DC power 399 also have short arrows labelled with reference number 399. An actual complete connection between supply 306 and each component it supplies power to is left off for simplicity. There would typically be a complete source-to-component power connection. The same is true for other similar power connections in the other drawings. The positive lead from driver positive terminal 307(+) powers LED fixture 30. The negative lead from LED fixture terminal 309 connects to shunt resistor 335 and to ground 301. Current through the fixture 30 during operation is on the order of 0.5-2 A. Voltage potential across driver positive and negative terminals 307 and 308 can be on the order of 100-1000 VDC or more. Shunt resistor 335 value is very low, on the order of 0.02-0.05 Ohms.

Driver voltage is measured as the drop across the load between the positive lead 303 and negative lead 309 at the fixture 30. Voltage divider 315 converts the high voltage across fixture 30 to a low voltage value, with a transfer factor on the order of H=1/300, resulting in a signal voltage on the order of 0.1-4.9 VDC. For example, if voltage across the fixture is 800 VDC, the value reported by voltage divider 315 would be 800/300=2.67 VDC. This value is reported to microcontroller 305 as a digital signal by way of A/D converter 310.

Driver current is measured by calculating the voltage drop across shunt resistor 335, using Ohm's law which states that I=V/R. Op-amp module 325 converts the very low voltage drop across shunt resistor 335 to a higher voltage, on the order of 0.1-4.9 VDC, depending on driver and fixture configuration. For example, for a resistor value of 0.02 Ohms, if a voltage of 0.022 VDC is observed across shunt resistor 335, by Ohm's law current is 1.1 A (0.022V/0.02 Ohms=1.1 A). So for an op-amp where k=150, the output voltage will be 3.3 VDC (0.022V×150=3.3V). This voltage is reported to the controller 305 as an analog signal and will be interpreted by the controller as a current reading of 1.1 A.

Controller 305 outputs a 0-10 VDC dimming signal to driver 45 at terminals 346 and 347.

As illustrated in FIG. 2A, connections are made from the board 300 for the drivers 45*a*-45*d* for power via connectors 211-214, and for control via connectors 221-224, respectively. Various other connectors and inputs are provided for operation as follows: connectors 230 provide power input for power supply 306, FIG. 3. Connector 231 allows diagnostic and programming connection to the controller 305, FIG. 3. Connectors 232 allow connection of temperature sensors to controller 305. Switches 233 allow manual inputs to controller 305. Digital readout 234 provides information from controller 305 to a technician. Connectors 235 connect a communications network such as an RS-485 network to the controller 305. Connector 236 allows debugging the control board 300.

FIG. 2B diagrammatically shows the back side of board 300 and general areas where components or sub-systems such as 304, 381, 382, 383, 384 (see example in FIG. 3) can be mounted. This illustrates conceptually the example where different functional sections of the overall electrical system are in relative close proximity. These figures also illustrate how there can be multiple identical subsystems surfaced by the same board.

As can be appreciated, the current state of the art does not address the needs for controlling or monitoring multiple non-isolated LED drivers using a single controller. Thus when multiple drivers are used, multiple controllers are required. This leads to extra cost, extra wiring and control circuits, and excessive space usage in control enclosures having very limited interior space.

B. Exemplary Method, System, and Apparatus Embodiment 1

One solution for LED driver systems that do not provide isolation between AC power input and DC power output is to ensure that any control and monitoring systems maintain galvanic isolation from each other and the controller. This necessitates creating an isolated controller section, isolated channels, and isolated power supplies for each channel, with a signal ground or reference that is isolated with reference to the other circuits. In these systems, the DC(−) lead from each driver is galvanically connected only to an isolated power supply reference, and not to other drivers. Likewise, communications are isolated. Measurements and control signals such as voltage and current values and dimming commands to drivers are communicated across the isolation boundary by magnetic, optical, RF, capacitive, or other non-galvanic coupling methods. However, since some non-isolated drivers may have an isolated dimming input, dimming control may optionally be isolated or not as needed.

The result of these improvements is improved operation and durability by eliminating problems caused by non-isolated grounding.

A controller such as in FIG. 4 and its operation may be further described as follows: a controller 405, FIG. 4 controls up to four separate drivers 45 and associated fixtures 30 (only one each shown for simplicity); it also monitors fixture voltage and current in order to provide that information for use in lighting system operation and management. Driver 45 powers fixture 30 at a power level commanded by main control. Note that the board 400 as illustrated uses one controller 405 to control up to four drivers. The discussion below describes the construction and operation of board 400 with reference to a single driver; however operation for all four drivers is the same and connections would basically parallel those shown for driver 45 in FIG. 4. Drivers and fixtures are connected to the control board 400 by way of connectors 511-514 and 541-544 (See FIG. 5A). Many different types of connections are possible as long as connections are appropriately rated for DC voltages as used in the particular application. 0-100V drivers will require less physical spacing for connectors, for example, than will 0-1000V drivers.

Figure 4:
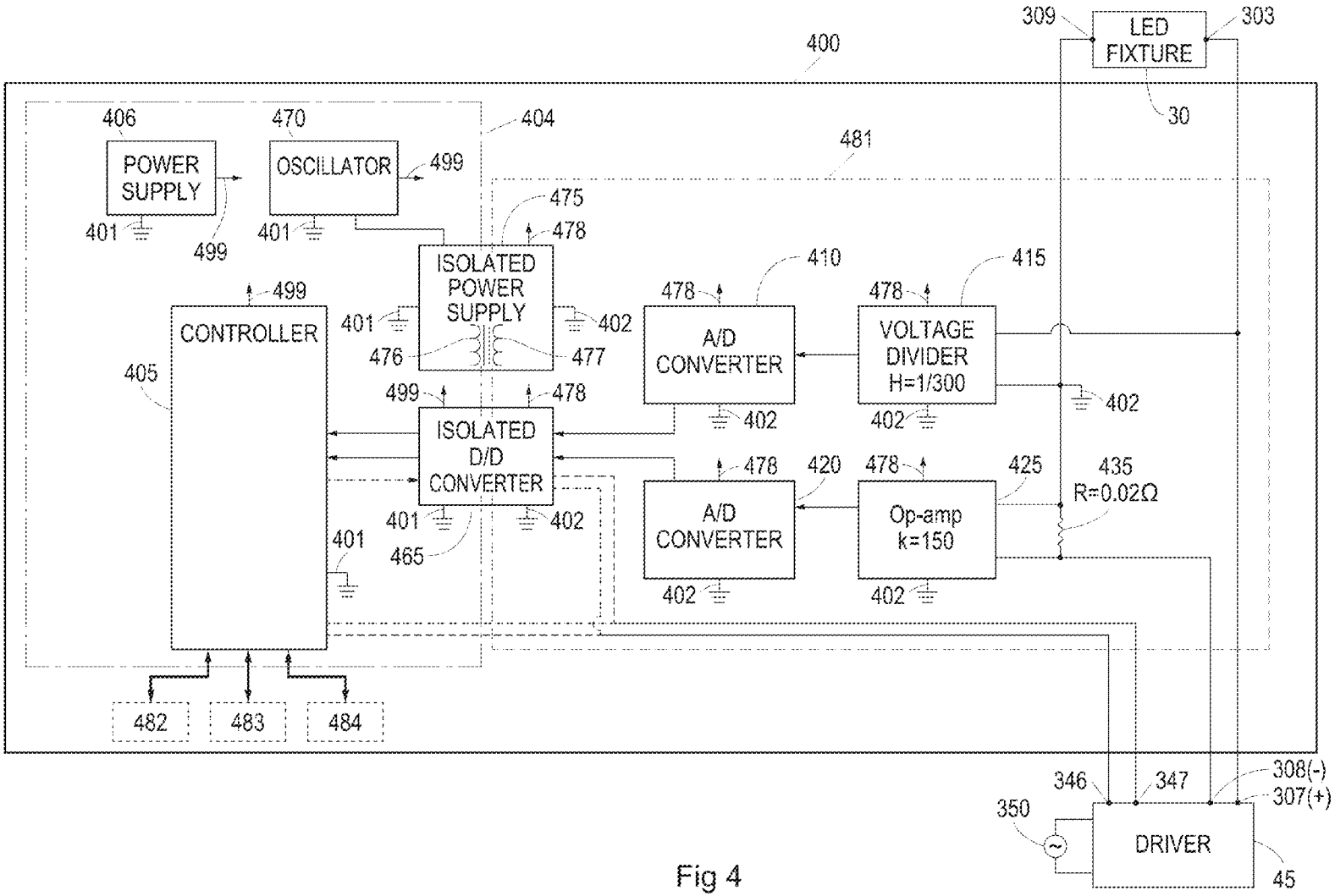
FIG. 4 illustrates a functional diagram of a control board and related components according to aspects of and an exemplary embodiment according to the invention.
Figure 5A:
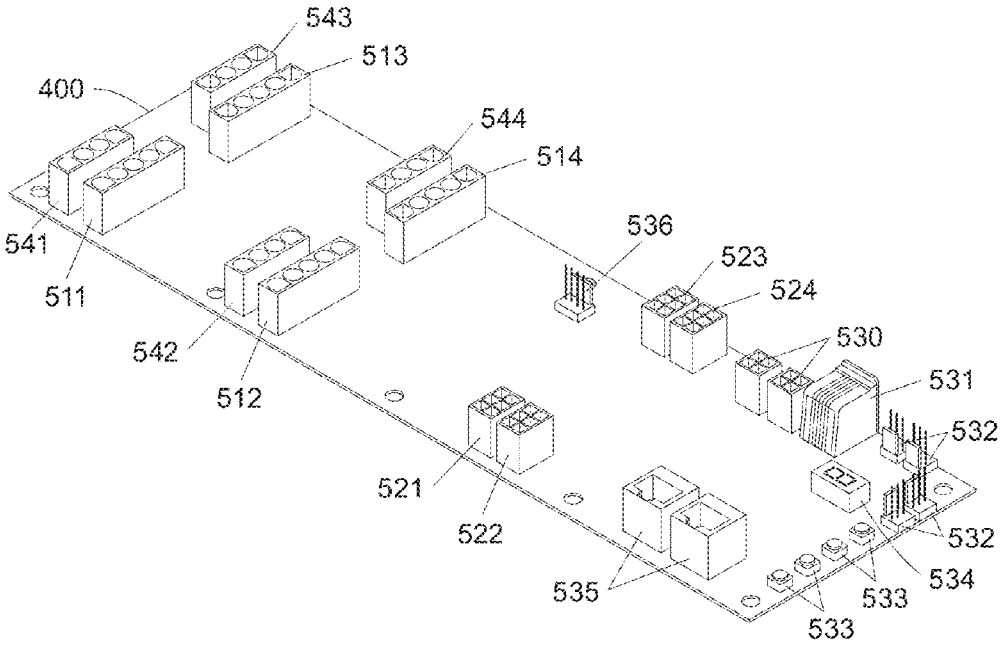
FIGS. 5A-5B illustrate respectively a top and bottom diagrammatic view of a control board according to exemplary aspects of the invention.
Figure 5B:
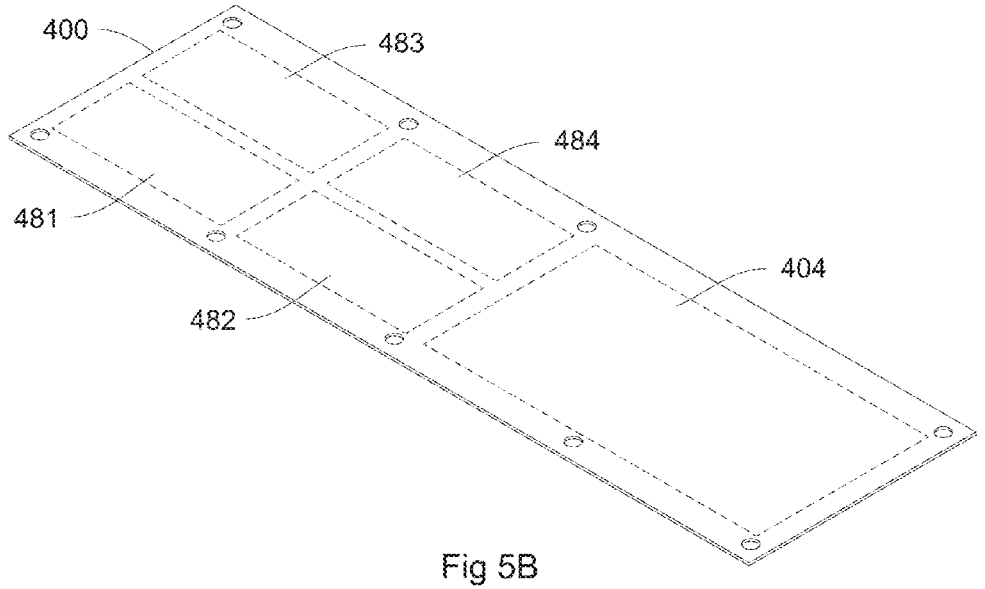

Control board 400 contains controller module 404 with main controller 405, and I/O modules 481, 482, 483, and 484 (See FIG. 5B). Module 481 is shown in detail in FIG. 4, but the remaining three I/O modules function identically. Each of these modules is connected by way of typical circuit board traces from the isolation components to the main controller. Controller module 404 is galvanically isolated from each I/O module and each driver; each I/O module is likewise isolated from the other I/O modules. Grounds include main ground 401 and isolated ground 402. For purposes of illustration and description, components within the isolation boundary defining each I/O module (i.e. modules 481-484), isolated ground 402 will be shown and assumed to be provided, whether or not specifically referenced below. Main power supply 406 provides DC power 499 to components on controller module 404, including oscillator 470, isolated digital-digital converter 465, and controller 405.

Oscillator 470 is grounded at main ground 401. It provides a variable frequency digital input signal to primary winding 476 in isolated power supply 475, which induces an AC signal into secondary winding 477. This A/C signal is conditioned to create a low voltage DC power source of DC power 478, which is isolated from the controller module 404, and which supplies power to isolated electronic components. Isolated power supply 475 forms the isolation boundary for the power supplies for each I/O module and is therefore associated with main ground 401 on the controller side and isolated ground 402 on the I/O module side. Note that power supply functions for isolated power supply 475 and main power supply 406 may consist of several discrete components or may be contained in a single package.

Isolated digital-digital converter 465 is used to provide galvanic isolation for digital signals. Isolation is on the order of 2000 VDC or more. It transmits digital signals across the isolation barrier using individual channels for bi-directional communication. These signals include voltage and current measurement values and may also include dimming or other control signals from controller 405 to each driver 45. As will be appreciated by those skilled in the art, by the term "dimming" it is meant that the controller controls what otherwise could be called a power level command (or something similar) to the drivers. The controller typically provides an ongoing signal which indicates at what power level the driver should operate the fixture. That level could be off, full on, or something in between (dimmed). It is possible the signal could be pulsed or variable, e.g. lights flashing or changing brightness. Therefore "dimming" refers to the ability of the controller to command the driver to power the LED fixtures in this embodiment at a desired power level which could be off, full on to the limit of the driver, or dimmed or some level in between. The dimmed level could be a level that was clearly less than what is considered to be normal for the fixture (e.g. lights left on low level after a game to allow safe exit of a stadium) or dimmed could be the normal "full on" level for a given fixture in a given location.

Each driver 45 is powered by AC mains power source 350. The positive lead from driver positive terminal 307(+) powers LED fixture 30. The negative lead 309 from LED fixture 30 connects to shunt resistor 435 and to ground 402. The circuit is completed from shunt resistor 435 to driver negative terminal 308. As previously noted, voltage across driver positive terminal 307 and negative terminal 308 is high, on the order of up to 1000 VDC. Of course higher voltage levels could be accommodated according to varying driver design and field conditions, as long as components on isolated boards are rated for appropriate voltage levels to maintain isolation integrity.

Voltage divider module 415 converts the high voltage across fixture 30 to a low voltage value, with a transfer factor on the order of H=1/300, resulting in a signal voltage on the order of 0.1-4.9 VDC. For example, if voltage is 800 VDC, the value reported by voltage divider 415 would be 800/300=2.67V. This value is reported to A/D converter 410 which supplies a digital signal with a frequency proportional to input voltage. This digital signal is supplied to isolated digital-digital converter 465 which repeats the digital signal to microcontroller 405. The digital signal is interpreted by the microcontroller as a voltage value across fixture 30. Signal value frequencies are on the order of 1-150 KHz.

Op-amp module 425 converts the very low voltage drop across shunt resistor 435 to a higher voltage on the order of 0.1-4.9 VDC, depending on driver and fixture configuration. For example, for a shunt resistor 435 value of 0.02 Ohms, if a voltage of 0.022 VDC is observed across shunt resistor 435, by Ohm's law current is 1.1 A (0.022V/0.02 Ohms=1.1 A). So for an op-amp where k=150, the output voltage will be 3.3 VDC (0.022V×150=3.3V). The higher voltage is reported to the controller 405 as a digital signal by way of A/D converter 420.

Controller module 404 includes part of isolated digital-digital converter 465. Controller 405 accepts isolated voltage and current readings as digital inputs. Controller module 404 sends out an analog voltage control signal to isolated control input or optionally sends out a digital signal to each isolated I/O module. Controller module 404 receives DC power 499 from power supply 406.

For normal operation of the controller board and components as described, connections are made from the board 400, FIG. 5A, to the drivers for power via connectors 511-514, for current measurement via connectors 541-544, and for control output to drivers via connectors 521-524. Various other connectors and inputs are provided for operation as follows: connectors 530 provide power input for power supply 406, FIG. 4. Connector 531 allows diagnostic and programming connection to the controller 405, FIG. 4. Connectors 532 allow connection of temperature sensors to controller 405. Switches 533 allow manual inputs to controller 405. Digital readout 534 provides visual information from controller 405. Connectors 535 connect a communications network such as an RS-485 network to the controller 405. Connector 536 allows debugging the control board 400. FIG. 5B is a diagrammatic back-side depiction of board 400 with areas of modules, components, or isolation generally indicated as per FIG. 4. This again shows how multiple functional sections can exist on the same board.

As can be seen in FIGS. 4 and 5A-B, as compared to FIGS. 2A-B and 3, galvanic isolation between communication of the measurement functions and the controller includes use of a transformer and a D/D converter. Communication of voltage and current measurements from the right side of FIG. 4 is therefore galvanically isolated relative to controller 405. As indicated by the different reference numbers 401 and 402, these two functional sections do not share common ground. It is to be understood, however, that there is still galvanic connection between the AC main power 350 and each driver 45. This embodiment addresses the previously described problem of non-isolated drivers presenting the risk of damaging currents and EMI that would travel across those sections. And it is to be understood that additional drivers 45 could be added to the system of FIG. 4 in a similar manner as section 481; retaining galvanic isolation by requiring the communication of measurements for a driver fixture combination to have the same sort of isolation as components 475 and 465.

This is novel to the industry, since existing art does not allow the use of multiple non-isolated LED drivers to be controlled or monitored by a single control unit. The current state of the art would require a single control unit to be dedicated to each driver, so the invention is beneficial in that it can reduce cost, reduce space required in control enclosures, reduce complexity of systems that integrate individual controllers, and can prevent equipment damage.

C. Exemplary Method, System, and Apparatus Embodiment 2

Figure 6:
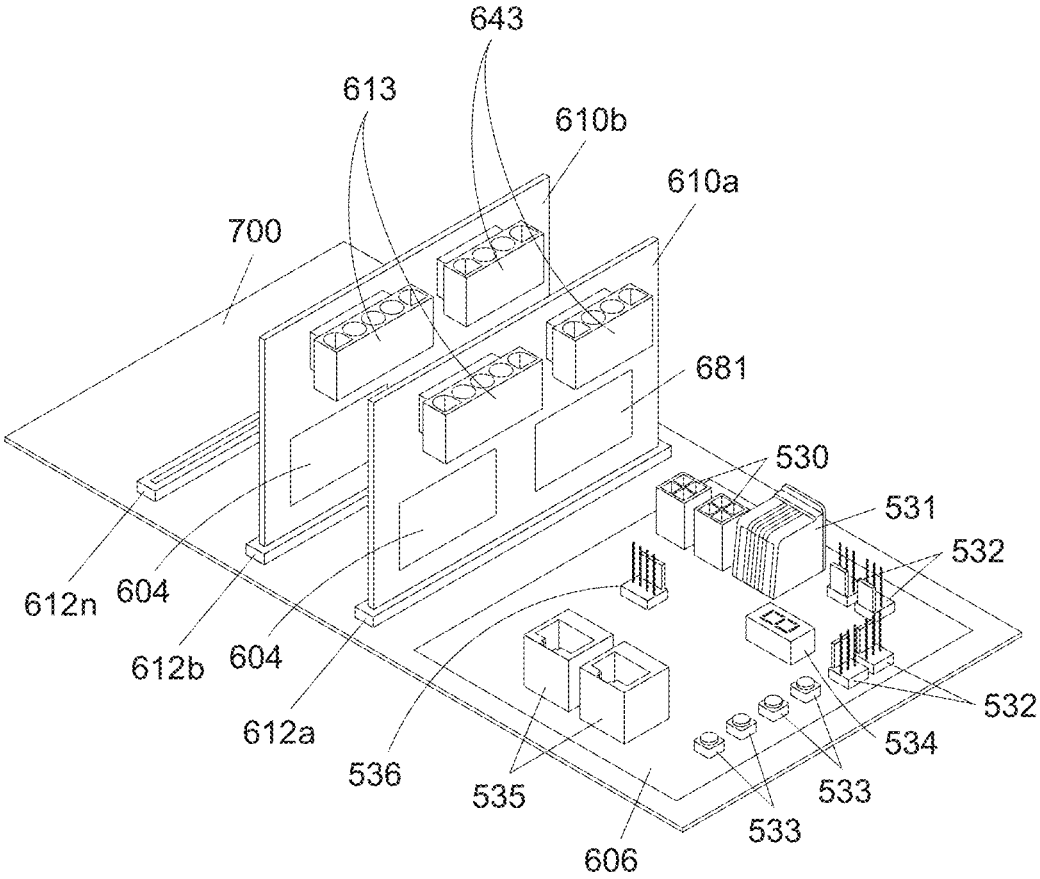
FIG. 6 illustrates a diagrammatic view of an apparatus for controlling devices according to exemplary aspects of the invention.
Figure 7A:
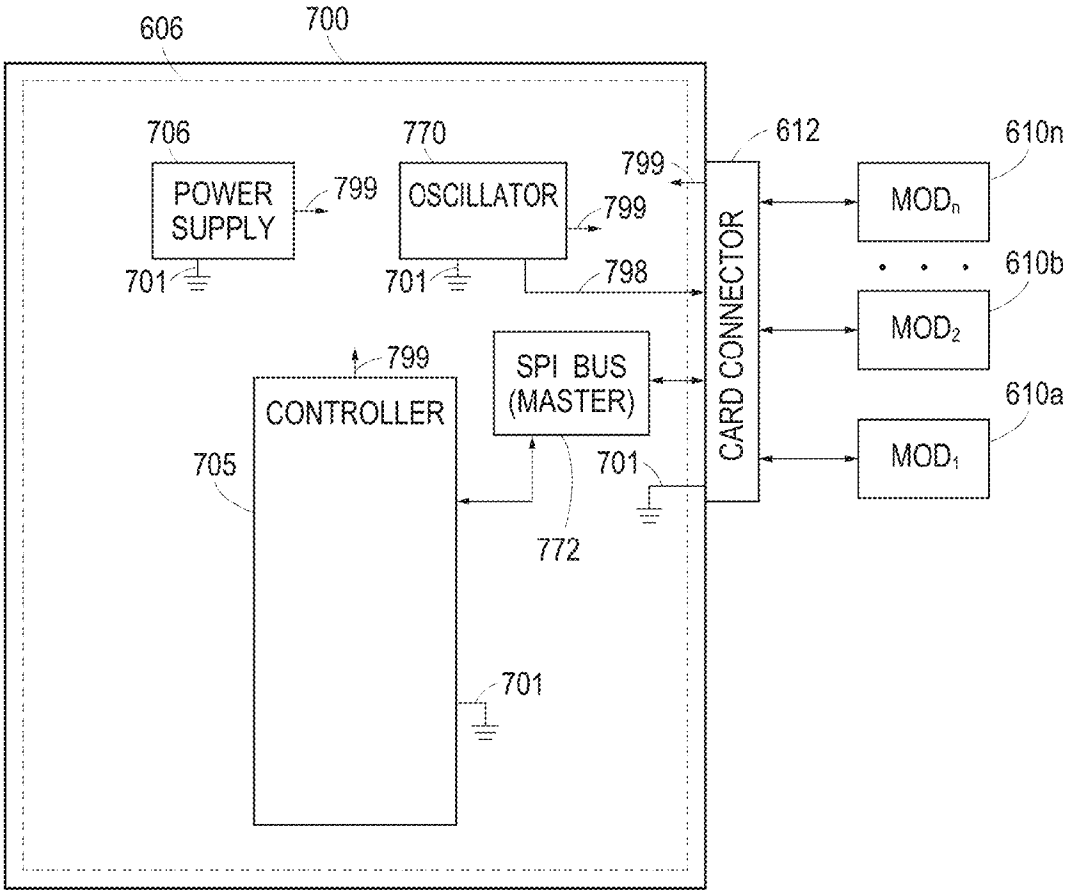
FIGS. 7A-7B illustrate functional diagrams of a master and slave control boards, respectively, and related components according to exemplary aspects of the invention.
Figure 7B:
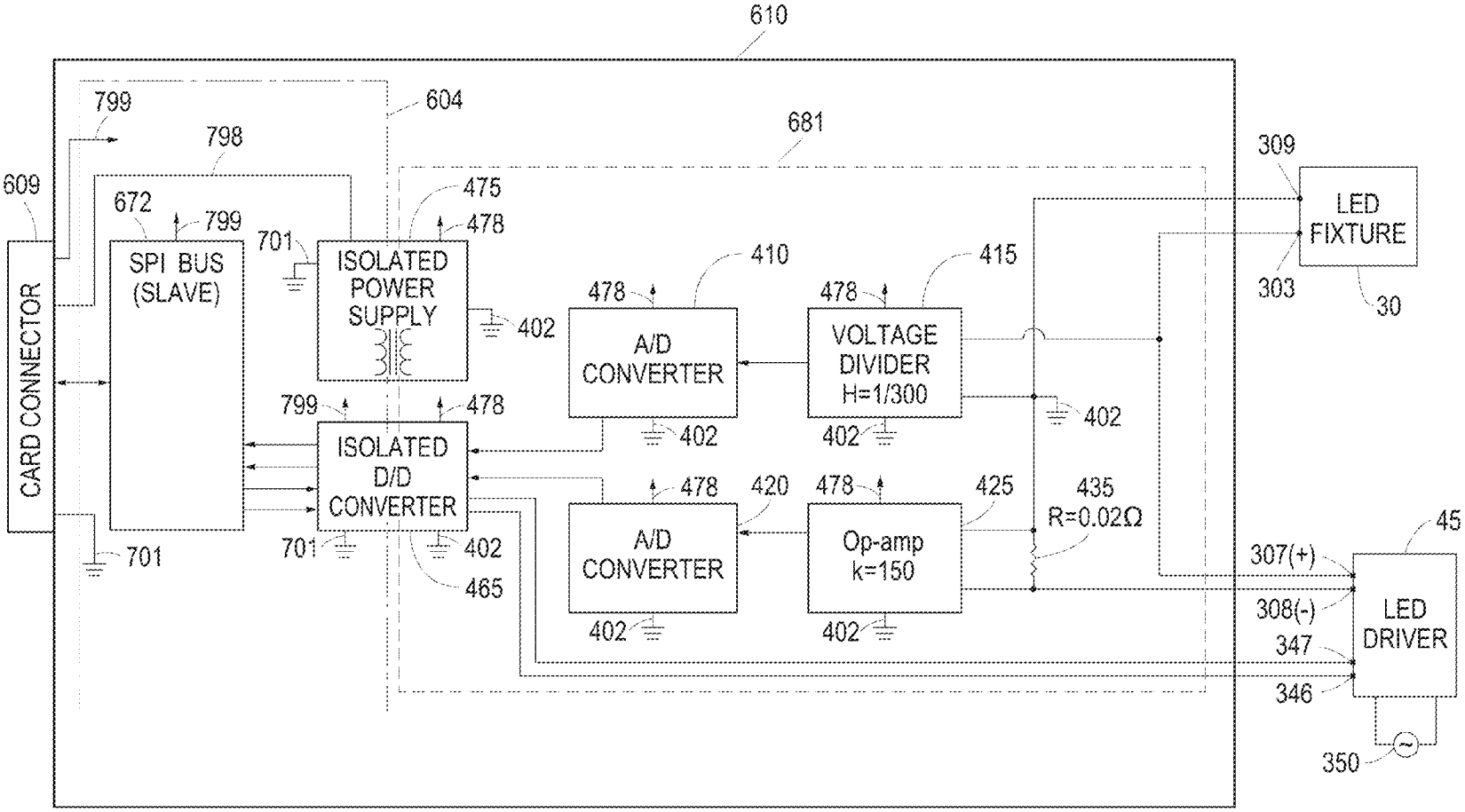

A second embodiment is shown in FIG. 6 and FIGS. 7A-B, and described as follows: main controller 705, FIG. 7A, is part of controller module 606 on main board 700. It controls and monitors one or multiple drivers 45 and associated fixtures 30 by way of I/O modules 610*a-n*. One controller 705 may control as few as one I/O card 610, or as many as 16 or more in this embodiment.

The discussion below describes the construction and operation of board 700 with reference to a single I/O module 610; however operation for individual I/O modules may vary and may incorporate various features from existing or proposed control modules; particularly with reference to previously listed or possible variances of power and control system grounding.

I/O cards 610, FIGS. 6 and 7B, are designed to function similarly to I/O modules 481-484, FIG. 4, however cards may be removed or added from the system by removing or installing the male card connector 609 from or to the corresponding female card connector 612 on board 700. The I/O cards interface with controller module 606 by way of a digital communications bus system. One example of such a communications bus which is well-known in the industry is a Serial Peripheral Interface (SPI) Bus. SPI is a synchronous serial data link that operates in full duplex mode and is used for short distance single master communication. Other communications bus systems could also be used as long as they are capable of addressing the desired number of controllers at the desired information bandwidth.

Operation of control module 606 is similar to the main control module 404 of the previous embodiment; however a hard circuit connection between monitoring and control circuits on the I/O modules by way of the isolated digital-digital converter 465 is not used. Instead SPI bus master unit 772 on control module 606 is used to communicate with a single SPI bus slave unit 672 per I/O module. Each SPI slave unit connects with isolated digital-digital converter 465 which non-galvanically bridges isolated zones 604 and 681, as was previously described with reference to digital-digital converter, FIG. 4.

Controller module 606 is galvanically isolated from each I/O module 681 and each driver. I/O Card 610 contains two zones which are mutually galvanically isolated. Zone 604 interfaces with the master controller. Zone 681 interfaces with the LED driver and fixture. The intermediate zone 604 on card 610 is galvanically connected to main board 606 but galvanically isolated from the actual I/O module 681. This allows the SPI slave unit 672 and the isolated digital-digital converter 465 to be powered by the main controller module 606.

Main power supply 706 provides DC power 799 to components on controller module 606, including oscillator 770, controller 705, and SPI bus master 772. Power 799 is also supplied across the card connector 612 to SPI bus slave 672, and isolated digital-digital converter 465. Oscillator 770 provides a variable frequency digital input signal 798 across card connector 612 to isolated power supply 475, which in this embodiment operates similarly to isolated power supply 475, FIG. 4. Grounds include main ground 701 which is found both on main controller module 606 and intermediate zone 604, and isolated ground 402 which is found on each I/O module 681.

Further operation of the modules 681 is the same as previously described for I/O modules 481 FIG. 4, except for the addition of the previously described SPI bus. For normal operation of the controller board and components as described, connections are made from the board 700 at controller module 606, by way of various items as previously described including power supply input connectors 530, diagnostic connector 531, temperature sensor connectors 532, switches 533, digital readout 534, communications connectors 535, and debugging connector 536. Of course other components or systems may be added to the modules to perform the same functions, or to perform different functions as desired.

A few examples of other connectors are shown in FIG. 6; e.g. power connectors 613 (like connectors 511-514 of FIG. 5A); measurement connectors 643 (like 541-544 of FIG. 5A).

As can be appreciated in the embodiment of FIGS. 6 and 7A-B, use of isolated power supply 475 and isolated D/D converter 465 again galvanically isolates controller 705. Drivers 45 still have galvanic connection to AC mains source 350. But the galvanic isolation afforded by components 475 and 465 allows the communication functionality regarding operating parameters of drivers 45 to be passed to controller 705 non-galvanically or with galvanic isolation to address the risk of ground currents and EMI even in this context where there is a plug-in card 610 separate from controller board 700. Again, analogous galvanic isolation can occur for multiple driver/fixture combinations (as indicated at 610A, 610B, . . . 610N in FIGS. 6 and 7A).

This embodiment provides an amount of flexibility. Cards 610 can differ so long as they can communicate on SPI bus 672 to controller 705. This does not require identical cards 610. Additionally, the system can potentially work even if there are different drivers 45 or fixtures 30. For example, driver 45 might have partial or full galvanic isolation or not. Allowing different plug-in cards provides flexibility of adding additional drivers and loads (or subtracting). But in any of the cases, the communication functionality (or other functionalities) between the card 610 side and the controller board 700 side can include a substantial amount of galvanic isolation.

Still further, each card could incorporate more than one isolated controller area, such that a dual, quad, or other plural channel configuration could be utilized within a single controller card, similar to the first embodiment discussed above. This could allow even greater numbers of channels within a given physical space, and would more likely be limited by the physical requirements for connector space (due to the need for separation of high-voltage conductors) than it would be by the ability to reduce the size of the control circuitry.

This embodiment as described above is novel and beneficial, since the current state of the art requires a single controller for each non-isolated driver. So in a pole structure supporting 16 drivers, while the embodiment just described would only require a single controller with a card for each driver, or even a single card for two or more drivers, the current state of the art would require 16 separate controllers, concomitant space in a control enclosure, and the ability to address those 16 controllers with separate communications protocols. It is quite apparent that being able to eliminate that many components, reduce control complexity, and greatly reduce enclosure space requirements is of great benefit in the industry.

D. Exemplary Method and Apparatus Embodiment 3

Figure 8:
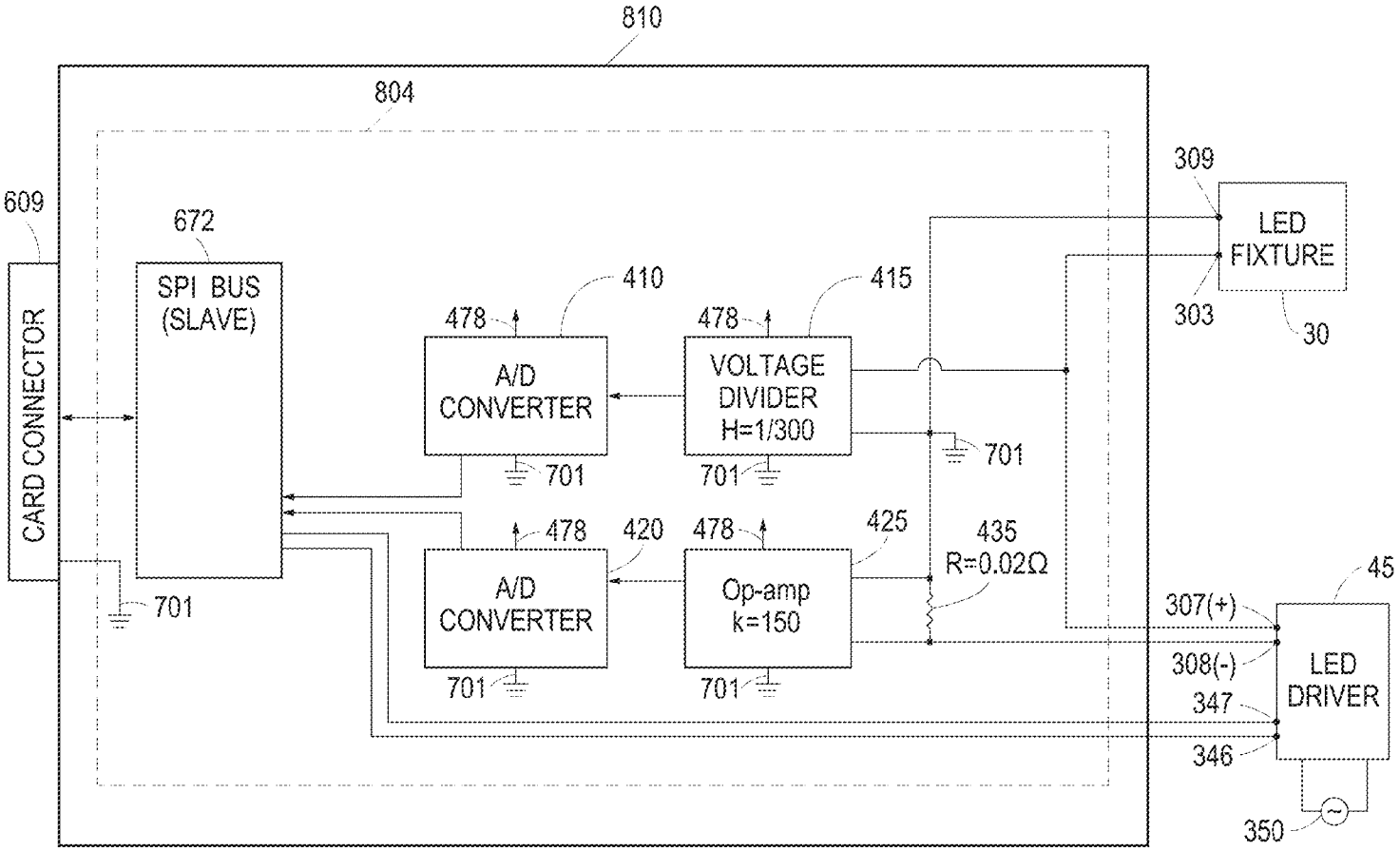
FIG. 8 illustrates a functional diagram of a non-isolated slave control board according to exemplary aspects of the invention.

A third embodiment is shown in FIG. 8. A master control card 700, FIG. 7A is used as previously described. An I/O card 810 is used to interface with the master controller card. However since some LED drivers are internally isolated, I/O card 810 and its control section 804, FIG. 8, does not require isolation from the master control card. It therefore is configured similarly to the non-isolated control card illustrated in FIGS. 2A-B and FIG. 3; however with the benefit that it can be used with and controlled by the same master control card 700 that could at the same time be controlling drivers which require full isolation.

As discussed above, using the same type of removable card and plug-in slots on a control board as in FIG. 6, this embodiment moves the galvanic isolation of driver 45 out to at or near driver 45 (as opposed to being built in to the card, here a reference number 810). For example, instead of an isolated power supply 475 with transformer that galvanically isolates power, and/or an isolated D/D converter 465 that galvanically isolates communications to and from controller 405 as being on board a control card as in board 400 of FIG. 4, or on board card 610 in FIG. 7B, those type of components could be built in to each LED driver 45. Thus, galvanic isolation between driver(s) 45 and controller 705 is accomplished. In other words, each driver 45 has internal galvanic isolation. Thus there could be a common ground 701 between controller board 700 and each card 810 and still maintain galvanic isolation and reduce, deter, or eliminate real risk of unwanted currents between the LED driver/fixture combinations and the controller. This is another way of addressing the identified problem in a slightly different manner. It presents other options and flexibility.

This embodiment again provides a novel and beneficial improvement to the art, by again reducing the number of controllers required, by reducing the complexity of systems required to interface with the controllers, and by reducing the space required for controllers that must interface with disparate lighting systems.

E. Exemplary Method and Apparatus Embodiment 4

Figure 9:
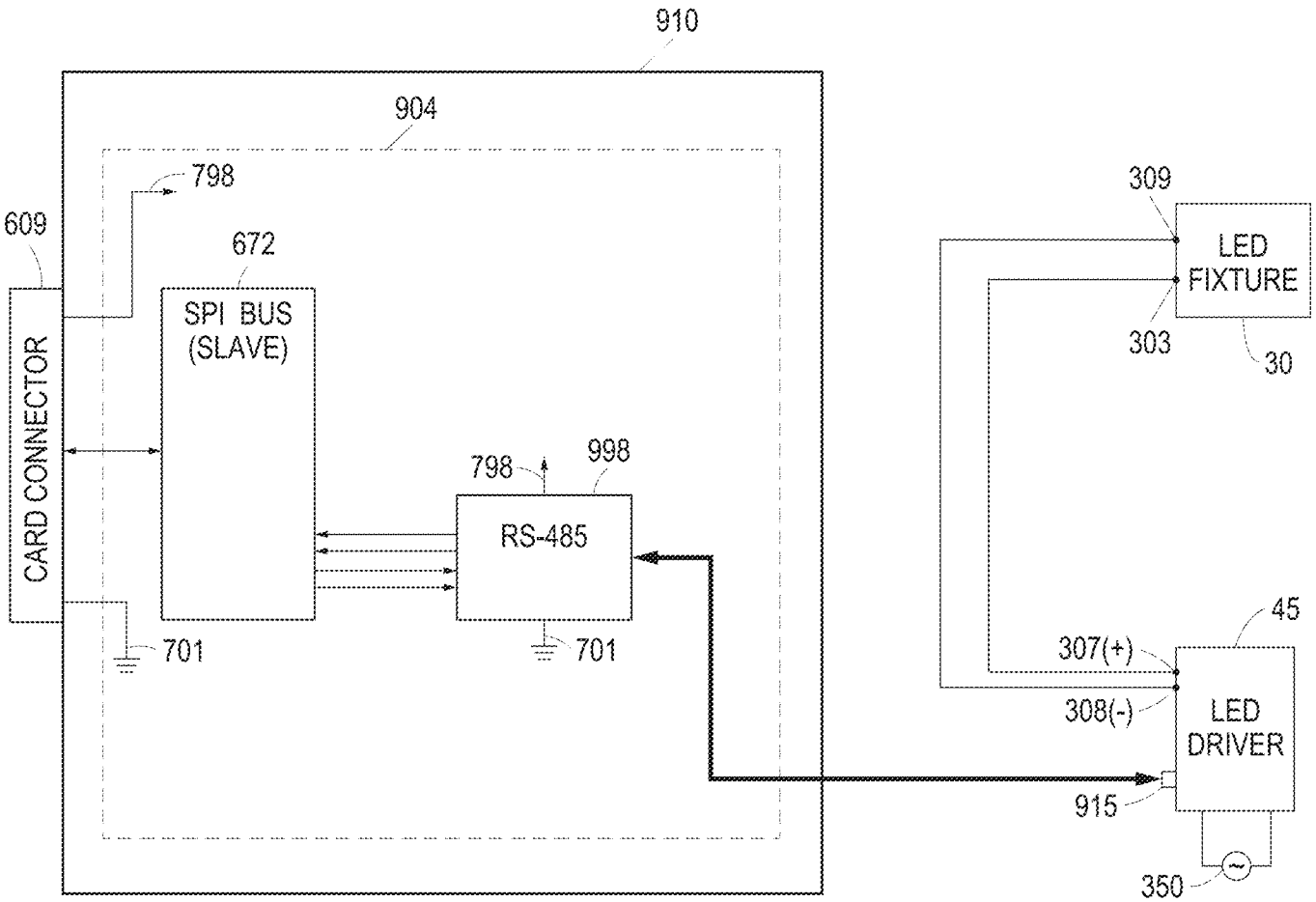
FIG. 9 illustrates a slave control board using a network protocol device for controlling LED drivers or other devices, according to exemplary aspects of the invention.

A fourth embodiment is shown in FIG. 9. A master control card 700, FIG. 7A, is used as previously described. An I/O card 910 with controller module 904 contains SPI bus slave unit 672 and RS-485 communications module 998, which connects to LED driver 45 at RS-485 connector 915. The card is used to send control signals via RS-485 protocol to LED drivers or other devices, and can also receive information from the LED driver which could include current and voltage information.

As mentioned, another illustrative alternative for galvanic isolation in this context again puts some of the solution at or near each driver 45 instead of on the communication card (here reference number 910 in FIG. 9). The digital communication protocol via RS-485 connection de facto is galvanic isolation of the communication functions between controller 705 and each LED driver/fixture combination. There may or may not be galvanic isolation (full or partial) between AC power mains 350 and drivers 45. But this would place necessary components on or at drivers 45 to accomplish the RS-485 isolation. This embodiment again provides novel and useful benefits, by making an isolated universal controller platform for interfacing with LED lights and many other devices within the constraints of limited space and a need for reducing cost and complexity in electrical systems used for not only lighting but many other functions.

F. Options and Alternatives

The invention may take many forms and embodiments. The foregoing examples are but a few of those. To give some sense of some options and alternatives, a few examples are given below.

Dimming or other control signals from the controller can be sent directly to drivers without using isolated I/O modules if the drivers provide galvanic isolation between the control signal input and the driver. Control signals could be various types of digital or analog signals, including RF, wireless, fiberoptic, etc.

Although physical size of components makes it convenient to combine four drivers with a single controller in a single electrical enclosure, controller boards may be manufactured to accommodate fewer or more than four channels.

Operational modules may be contained in a single package, may combine two or more separate functions into a single package, or may comprise several discrete components as in the case of the isolation transformer module 475 previously described. Other physical combinations of functions are possible as well.

As can be appreciated by those skilled in the art, the components discussed are commercially available. The designer would select the appropriate off-shelf components for specific applications. This would include such things as programmable controllers, isolated power supplies, isolated D/D converters, and the other components illustrated in the drawings. This would include LED drivers that have on-board galvanic isolation (full or partial). Variations obvious to those skilled in the art would be included within the invention.

An example of a galvanic isolation component used for communications is US patent application 2012/0002377, which is incorporated by reference herein.

An example of a typical isolated power supply (such as reference number 475 FIG. 4) is commercially available MAX253 from Maxim Integrated, 160 Rio Robles, San Jose, Calif. 95134, U.S.A.

An example of a typical isolated D/D converter (such as reference number 465 of FIG. 4) is commercially available model Si8640 from Silicon Laboratories, 400 West Cesar Chavez, Austin, Tex. 78701, U.S.A.

An example of a typical micro controller that might be used with one or more of the above embodiments is micro controller PIC24 commercially available from MICROCHIP Technology Inc., 2355 West Chandler Blvd., Chandler, Ariz. 85224, U.S.A. (such as reference number 405 of FIG. 4).

Additional information regarding isolated v. non-isolated circuits can be found at www.tabertransducer.com/isolated-non-isolated (incorporated by reference herein accessed on the Internet on Aug. 20, 2015). The isolated circuit has an additional block (fourth from left) that is a DC/DC converter (basically just a transformer). It is magnetically coupled meaning the insulated input wires are wrapped around a metal (or ferrite) core, and the insulated output wires are wrapped around the same core but due to insulation, the wires never make direct contact. Thus creating the "isolated" portion of the design. The energy is magnetically coupled through the wires but the wires never make direct contact.

An exemplary non-isolated power supply is the Evada CHF-100-050-FB4 and the CHF-100-070-FB4, commercially available from Evada Electronics Co., Ltd. No. 39-2, Xiayang road, Haicang District, Xiamen Ciuty, Fujian Province, China 361026.

An exemplary isolated power supply is the Rohm BP5875 available from ROHM Semiconductor U.S.A., LLC, 3800 N. Wilke Road, Suite 230, Arlington, Heights, Ill. 60004, U.S.A.

A further exemplary isolated power supply is described in U.S. Pat. No. 8,698,421, which is incorporated by reference herein.

A further exemplary non-isolated power supply is described in U.S. Pat. No. 8,587,278, which is incorporated by reference herein.

What is claimed is:

1. A system for LED lighting comprising:

a. plural LED drivers and associated LED fixtures;

b. a main controller; and c. plural galvanically isolated interface channels so that isolation exists between individual LED drivers and individual LED drivers and the main controller.

2. The system of claim 1 wherein the isolated interface channels monitor LED driver parameters and communicate information about said parameters to the main controller without compromising galvanic isolation.

3. The system of claim 2 wherein the parameters monitored are driver voltage and current.

4. The system of claim 1 wherein the controller provides control signals to plural LED drivers.

5. The system of claim 4 wherein the control signals are communicated across said isolation to said interface channels.

6. The system of claim 5 wherein the interface channels further communicate the control signals to associated drivers.

7. The system of claim 2 wherein isolation is maintained between individual drivers and between the individual drivers and the controller.

8. The system of claim 2 comprising a single board having a control section and further having interface sections wherein the interface sections are galvanically isolated from each other and from the control section.

9. The system of claim 2 wherein the galvanic isolation is sufficient for high voltage differentials.

10. The system of claim 9 wherein the high voltage differentials are on the order of one or more thousands of volts.

11. The system of claim 2 wherein the isolated interface channels comprise an addressable bus system.

12. The system of claim 11 wherein the isolated interface channels are connected to the main controller by means of mating connectors.

13. The system of claim 11 wherein the isolated interface channels comprise different isolation architectures adapted to different LED controllers.

14. A method to operate one or more drivers associated with light sources utilizing a single controller for communication to and from the driver/light sources combination comprising:

a. galvanically isolating the controller from the driver/light sources combination;

b. allowing communication between the controller and the driver/light sources combination;

c. wherein one or more of the drivers has:

i. a different power source from the controller or from one or more of the other drivers; or ii. a different ground reference from the controller or from one or more of the other drivers.

15. The method of claim 14 wherein the communication comprises information or data related to at least one of operating parameters of the driver and/or light sources combination or instructions to the driver and/or light sources combination.

16. The method of claim 14 wherein the driver/light sources combination relates to high power and high current operation.

17. The method of claim 16 wherein the drivers comprise non-isolated LED drivers and light sources comprise LEDs.

18. The method of claim 14 wherein galvanic isolation comprises setting up galvanically isolated interface channels allowing at least one way communication over each channel.

19. The method of claim 14 comprising plural drivers and the galvanic isolation is between the plural drivers as well as the drivers and the controller.

20. The method of claim 14 wherein the method is applied to drivers comprising plural LED drivers of plural LED fixtures of a wide area lighting system comprising one or more fixtures elevated on elevating structures, each elevating structure including an enclosure that can include at least the controller and drivers.

21. A system for operating one or more drivers of LED light sources with a central control subsystem comprising:

a. a central control including a digital programmable controller that has inputs and outputs that relate to control functions for the drivers and information about operating parameters of the drivers;

b. a main electrical power connection to operatively supply high power, high current electrical power to the drivers;

c. a galvanic isolation subsystem between each driver and the controller, the galvanic isolation deterring or preventing unwanted current falling between the main power and control functionalities whether or not main power to drivers is galvanically isolated and whether or not a ground is shared;

d. wherein said main electrical power connection for the drivers is separate from or has a separate ground reference from at least one of the controller or other drivers.

22. The system of claim 21 wherein galvanic isolation includes at least one of: inductive/transformer, opto-isolation, capacitive, acoustic, mechanic, or other forms of galvanic isolation.

23. The system of claim 21 wherein communication comprises at least one of: operating parameters of the driver or light sources, instructions for the driver, or other.

24. The system of claim 21 wherein the system can include a combined controller and communication board or a separate control board with one or more communication boards, or a galvanically isolated communication path.

* * * * *